US008795469B2

(12) United States Patent
Golfman

(10) Patent No.: US 8,795,469 B2
(45) Date of Patent: Aug. 5, 2014

(54) METHOD FOR PREPARING NONWOOD FIBER PAPER

(75) Inventor: Jeff Golfman, Winnipeg (CA)

(73) Assignee: Prairie Paper Ventures Inc., Winnipeg MB (CA)

( * ) Notice: Subject to any disclaimer, the term of this patent is extended or adjusted under 35 U.S.C. 154(b) by 0 days.

(21) Appl. No.: 13/167,805

(22) Filed: Jun. 24, 2011

(65) Prior Publication Data

US 2012/0006501 A1 Jan. 12, 2012

Related U.S. Application Data

(60) Provisional application No. 61/358,446, filed on Jun. 25, 2010.

(51) Int. Cl.

| | |
|---|---|
| ***D21H 11/12*** | (2006.01) |
| ***D21C 3/02*** | (2006.01) |
| ***D21C 3/20*** | (2006.01) |
| ***D21C 9/02*** | (2006.01) |
| ***D21C 9/10*** | (2006.01) |
| *D21C 9/14* | (2006.01) |
| *D21C 9/16* | (2006.01) |
| *D21C 9/147* | (2006.01) |
| *D21C 9/153* | (2006.01) |

(52) U.S. Cl.

CPC ..... *D21H 11/12* (2013.01); *D21C 3/02* (2013.01); *D21C 3/20* (2013.01); *D21C 9/02* (2013.01); *D21C 9/10* (2013.01); *D21C 9/14* (2013.01); *D21C 9/16* (2013.01); *D21C 9/163* (2013.01); *D21C 9/147* (2013.01); *D21C 9/153* (2013.01)

USPC ..... 162/148; 162/18; 162/19; 162/22; 162/24; 162/52; 162/56; 162/60; 162/70; 162/72; 162/97; 162/55; 162/98

(58) Field of Classification Search

CPC ..... D21H 11/12; D21H 27/00; D21C 3/222; D21C 3/02; D21C 5/00; D21C 3/22; D21C 9/005; D21C 3/24; D21C 3/26; D21C 9/02; D21C 9/10; D21C 9/14; D21C 9/16; D21C 9/147; D21C 9/153; D21C 9/163; D21C 9/18; D21C 3/20

USPC ..... 162/13, 18–19, 22–24, 52, 55–57, 60, 162/70, 72, 90–91, 97–99, 141, 148–149; 241/18, 21

See application file for complete search history.

(56) References Cited

U.S. PATENT DOCUMENTS

| | | | | | |
|---|---|---|---|---|---|
| 1,347,979 | A | * | 7/1920 | Werner | 162/17 |
| 1,430,115 | A | * | 9/1922 | Rindfusz et al. | 162/81 |
| 1,534,236 | A | * | 4/1925 | Adam et al. | 435/278 |
| 2,099,400 | A | * | 11/1937 | Jones | 162/55 |
| 2,161,763 | A | * | 6/1939 | Jones | 162/82 |
| 2,164,192 | A | * | 6/1939 | Marcham et al. | 162/11 |
| 2,388,592 | A | * | 11/1945 | Asplund et al. | 162/23 |
| 2,662,012 | A | * | 12/1953 | Teunissen | 162/82 |
| 2,686,120 | A | * | 8/1954 | Borden et al. | 162/14 |
| 4,040,899 | A | * | 8/1977 | Emerson | 162/13 |
| 4,384,920 | A | * | 5/1983 | Markham et al. | 162/19 |
| 4,652,341 | A | * | 3/1987 | Prior | 162/79 |
| 4,851,082 | A | * | 7/1989 | Mita et al. | 162/76 |
| 5,415,736 | A | * | 5/1995 | Grether | 162/111 |
| 5,626,945 | A | * | 5/1997 | Berzins et al. | 428/174 |
| 5,650,111 | A | * | 7/1997 | Gasland | 264/175 |
| 6,923,887 | B2 | * | 8/2005 | Pan | 162/6 |
| 7,186,316 | B1 | * | 3/2007 | Ryu et al. | 162/96 |
| 7,967,947 | B2 | * | 6/2011 | Goto et al. | 162/21 |
| 8,080,129 | B2 | * | 12/2011 | Yaqoob et al. | 162/97 |
| 8,142,616 | B2 | * | 3/2012 | Brogdon et al. | 162/179 |
| 8,303,772 | B2 | * | 11/2012 | Li et al. | 162/148 |
| 2001/0023749 | A1 | * | 9/2001 | Nay et al. | 162/21 |
| 2003/0070779 | A1 | * | 4/2003 | Bransby | 162/97 |
| 2003/0213568 | A1 | * | 11/2003 | Wester et al. | 162/7 |
| 2003/0213569 | A1 | * | 11/2003 | Wester et al. | 162/18 |
| 2003/0213570 | A1 | * | 11/2003 | Vrbanac et al. | 162/56 |
| 2004/0163779 | A1 | * | 8/2004 | Pan | 162/5 |
| 2004/0256065 | A1 | * | 12/2004 | Ahmed et al. | 162/26 |
| 2005/0022951 | A1 | * | 2/2005 | Eltheimer et al. | 162/65 |
| 2006/0207734 | A1 | * | 9/2006 | Day et al. | 162/70 |
| 2008/0078518 | A1 | * | 4/2008 | Goto et al. | 162/189 |
| 2009/0032208 | A1 | * | 2/2009 | O'Leary et al. | 162/60 |
| 2009/0090478 | A1 | * | 4/2009 | Hollomon et al. | 162/65 |
| 2010/0147474 | A1 | * | 6/2010 | Grass | 162/141 |
| 2010/0269991 | A1 | * | 10/2010 | Antensteiner | 162/55 |
| 2011/0061825 | A1 | * | 3/2011 | Li et al. | 162/13 |
| 2011/0114273 | A1 | * | 5/2011 | Yaqoob et al. | 162/23 |
| 2011/0226428 | A1 | * | 9/2011 | Goto et al. | 162/37 |
| 2011/0297343 | A1 | * | 12/2011 | Li et al. | 162/148 |
| 2012/0006501 | A1 | * | 1/2012 | Golfman | 162/181.1 |

FOREIGN PATENT DOCUMENTS

| | | | |
|---|---|---|---|
| CA | 1036304 | A * | 8/1978 |
| CA | 2731073 | | 7/2008 |

(Continued)

OTHER PUBLICATIONS

Hedjazi et al., "Alkaline sulfite-anthraquinone (AS/AQ) pulping of wheat straw and totally chlorine free (TCF) bleaching of pulps," 2009, Industrial Crops and Products 29, pp. 27-36.*

(Continued)

*Primary Examiner* — Jose Fortuna

(74) *Attorney, Agent, or Firm* — Michael R. Williams; Ade & Company Inc

(57) ABSTRACT

Paper comprised solely of a nonwood fiber mix is demonstrated to meet the technical physical specifications of commercially produced papers made from wood. The esthetically impressive paper meets nearly every technical specification of commercially produced paper.

26 Claims, No Drawings

(56) References Cited

FOREIGN PATENT DOCUMENTS

| | | | |
|---|---|---|---|
| CA | 2744961 | | 6/2011 |
| EP | 2224059 | A1 * | 9/2010 |
| WO | WO 8201019 | A1 * | 4/1982 |
| WO | 0012810 | | 8/1999 |
| WO | 2005001195 | | 6/2004 |
| WO | 2007004757 | | 7/2005 |
| WO | WO 2009015555 | A1 * | 2/2009 |
| WO | WO 2009015556 | A1 * | 2/2009 |
| WO | WO 2009056017 | A1 * | 5/2009 |
| WO | WO 2010066195 | A1 * | 6/2010 |

OTHER PUBLICATIONS

Abdul et al., "An optimization approach for the oxygen bleaching of kraft wheat straw cellulose," Jan. 1995, Tappi Journal, vol. 78, No. 1, pp. 83-89.*

Pekarovic et al., "Two-step straw processing—a new concept of silica problem solution," Department of paper Engineering, Western Michigan University, Date unknown, pp. 1-10.*

* cited by examiner

METHOD FOR PREPARING NONWOOD FIBER PAPER

PRIOR APPLICATION INFORMATION

The instant application claims the benefit of U.S. Provisional Patent Application 61/358,446, filed Jun. 25, 2010.

BACKGROUND OF THE INVENTION

The traditional source of fiber for paper in North America has been wood. Nonwood fiber has been used for the production of paper for thousands of years and is used as the main or exclusive source for paper in many countries.

As restrictions on the use of wood continue to increase, there is renewed interest in the production of paper products that meet or exceed the standards set by wood pulp products made from nonwood fiber, particularly nonwood fiber from annual plants.

SUMMARY OF THE INVENTION

According to a first aspect of the invention, there is provided a method of preparing photocopy paper, printing, laser graphic and many other paper types as well from a nonwood fiber source comprising: chopping a quantity of a dry nonwood fiber source to an average length between 1-100 mm or 3-75 mm or preferably 5-50 mm; wet processing the chopped material to remove dirt, fines and water-soluble extractives; dewatering the chopped material; heating the chopped material in the presence of 5-50% NaOH or 10-40% NaOH or preferably 12-30% NaOH and 0-10% or 0-5% or preferably 0-2% anthraquinone for 10-240 minutes or 15-200 minutes or preferably 20-150 minutes to a temperature between 100-240° C. or 120-200° C. or preferably 140-180° C.; washing the heated chopped material; bleaching the washed material; deflaking the bleached material; and forming the deflaked, bleached material into paper sheets.

As discussed herein, in some embodiments, the material may be cooled with water prior to washing and bleaching.

The nonwood fiber may be selected from the group consisting of flax, wheat and combinations thereof.

In some embodiments, 100% wheat is used.

In some embodiments, two fiber types are blended prior to deflaking.

Preferably, the flax is whole flax straw.

In some embodiments, a combination of flax and wheat is used. It is of note that suitable mixtures include 0.1%-99.9% wheat and 0.1%-99.9% flax. In some embodiments, the mixture is 60-90% wheat and 10-40% flax or 70-90% wheat and 10-30% flax or 75-85% wheat and 15-25% flax. In some embodiments, the nonwood fiber is approximately 80% wheat and approximately 20% flax.

In yet other embodiments, 80-100% wheat and 0-20% flax may be used.

According to a second aspect of the invention, there is provided a method of preparing a paper product from a nonwood fiber source comprising: chopping a quantity of a dry nonwood fiber source to an average length between 1-100 mm; wet processing the chopped material to remove dirt, fines and water-soluble extractives; dewatering the chopped material; heating the chopped material in the presence of 5-50% NaOH and 0-10% anthraquinone for 10-240 minutes to a temperature between 140-180° C.; washing the heated chopped material; bleaching the washed material; deflaking the bleached material; and forming the deflaked material into a paper product.

The paper product may be selected from the group consisting of photocopy paper, toilet paper, tissue paper, paper towels, wrapping paper, box board, photo paper, colored paper, commercial printer-grade paper (for use in book and periodical printing and publishing), writing paper, stationery, sack paper and paper board as well as many other paper types known in the art.

The nonwood fiber may be selected from the group consisting of: flax, hemp, jute, kenaf, oats, corn, alfalfa, wheat, barley and perennial grasses as well as others known in the art.

The perennial grasses may be selected from the group consisting of reed canarygrass, wild rye, switchgrass, bamboo and fescue. Other suitable grasses will be readily apparent to one of skill in the art.

DESCRIPTION OF THE PREFERRED EMBODIMENTS

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described. All publications mentioned hereunder are incorporated herein by reference.

Described herein are methods for making paper from nonwood fiber. Suitable plants include but are by no means limited to flax, hemp, oats, wheat, barley, jute, kenaf, cotton, corn, alfalfa, millet, perennial grasses, perennial plants and combinations thereof. Preferably, the whole straw of the plant is used. It is of note that this is in contrast with most bast plants which are decorticated or separated by other means (for example, by wet, dry, mechanical or other such means) and only the bast fibers or outer bark is used in paper. Specifically, it is noted that the bast is considered to be a long 'super-softwood' fiber while the core material is considered to be a weak hardwood-equivalent fiber. Typically, papermakers purchase the bast and the core material separately and blend them together to make their final product. This is because it is known that the core and the bast cook differently and accordingly it was assumed that their different chemical composition and particle geometry are not conducive to co-processing. However, described herein is the surprising discovery that the whole straw, comprising both bast and core, can be 'co-cooked' and used in the production of paper products.

As will be appreciated by one of skill in the art, this allows for the production of paper products at a considerably lower cost. It is of note that the discovery of the specific conditions is the result of several years of research and many unsuccessful trials prior to this discovery.

As discussed herein, it is definitively demonstrated that paper comprised solely of a nonwood fiber mix can meet the technical physical specifications of commercially produced papers made from wood. The main positive outcomes were the demonstration of producing aesthetically impressive paper that met nearly every technical specification of commercially produced paper.

As discussed herein, suitable plants are selected on the basis of a number of criteria, for example, cellulose content, hemicellulose content, lignin content, silica content, woody core content, fiber length and fiber width.

As will be appreciated by one of skill in the art, different combinations and percentages of plants may be used according to the intended use of the end product. For example, paper prepared according to the methods described herein may be used as photocopy paper, toilet paper, tissue paper, paper towels, wrapping paper, box board, photo paper, colored paper, printing paper, writing paper, stationery, sack paper, paper board and the like.

As will be appreciated by one of skill in the art, the bast content is proportional to the strength of the end product. Accordingly, for certain products, higher percentages of a high bast plant such as flax is more desirable.

As will be appreciated by one of skill in the art, the important properties include but are by no means limited to long fiber content for strength and stiffness, freeness for the rate of drainage of water and smoothness, brightness and opacity for printing surface quality.

In a preferred embodiment of the invention, a mixture of flax and wheat fiber is used to prepare photocopy paper. It is of note that suitable mixtures include 0.1%-99.9% wheat and 0.1%-99.9% flax, depending on the desired final properties of the paper, as discussed herein. In some embodiments, the mixture is 60-90% wheat and 10-40% flax or other suitable nonwood fiber source or 70-90% wheat and 10-30% flax or other suitable nonwood fiber source or 75-85% wheat and 15-25% flax or other suitable nonwood fiber source. In some embodiments, the nonwood fiber is approximately 80% wheat and approximately 20% flax or other suitable nonwood fiber source. As discussed herein, the whole straw of the flax and the wheat is processed and in some embodiments the processed material is mixed together prior to deflaking.

In some preferred embodiments, the mixture is 60-100% wheat and 0-40% flax or other suitable nonwood fiber source; 70-100% wheat and 0-30% flax or other suitable nonwood fiber source; 80-100% wheat and 0-20% flax or other suitable nonwood fiber source; 60-99.9% flax and 0.1-40% flax or other suitable nonwood fiber source; 70-99.9% wheat and 0.1-30% flax or other suitable nonwood fiber source; and 80-99.9% wheat and 0.1-20% flax or other suitable nonwood fiber source. In some embodiments the nonwood fiber source is wheat or is 100% wheat.

As discussed herein, nonwood fiber, for example, flax, hemp, oats, wheat, barley, jute, kenaf, cotton, corn, alfalfa, millet, perennial grasses, perennial plants and combinations thereof is chopped to a suitable average length. Preferably, the whole straw, comprising both bast and core material is used. It is of note that the specific average length will depend on the specific nonwood fiber used. Specifically, the length is selected so that the appropriate fiber length is maintained during further processing, as discussed below. For example, bast crop fiber length is largely maintained during chemical pulping and should be less than approximately 6 mm during some applications such as sheet formation. Accordingly, the nonwood fiber may be chopped to an average length between approximately 1-100 mm or between approximately 3-75 mm or preferably between approximately 5-50 mm. For example, for bast crops such as flax, hemp, jute, kenaf and the like, in some embodiments, a suitable average length is approximately 10 mm, for example, 5-15 mm. For cereals, for example, oats, corn, alfalfa, wheat, barley and the like and perennial grasses, for example, reed canarygrass, wild rye, switchgrass, bamboo, fescue and the like, in certain embodiments, a suitable average length is 10-50 mm. It is of note that longer fibers compromise sheet formation for example by clumping together in the sheet. On the other hand, short fibers tend to compromise tear strength It is of note that the fibers are preferably within the 1-6 mm range. It is of note that in some embodiments, depending on the intended use, the fibers may be 1-3 mm or may be 3-6 mm. It is of note that longer fibers (3-6 mm) lead to improvements in strength but may result in formation problems in certain applications but may be fine for other applications The chopped material is then wet processed to further adjust particle size and to remove dirt, fines and water-soluble extractives prior to cooking.

Following wet processing, the material is dewatered, for example, with a screw press. Preferably, the dewatering is carried out such that for example non-fibrous material, dirt and water-extractable components are removed.

The pulped material is then cooked to the desired kappa value depending on the intended use in the presence of sodium hydroxide (NaOH) and a cooking liquor. For example, the desired kappa value may be between 0-30, 5-25 or less than approximately 20. The pulped material may be cooked in a digester as discussed herein.

As discussed herein, the cooking conditions are dependent upon the material selected. For example, cotton, which has high cellulose content and very low lignin content does not require much cooking or bleaching.

In general, sodium hydroxide is added at approximately 5-50% or approximately 10-40% or preferably approximately 12-30% of dry fiber weight and anthraquinone (AQ) is added at approximately 0-10% or approximately 0-5% or preferably 0-2% on a dry fiber basis. The chopped material is cooked at a temperature between approximately 100-240° C. or approximately 120-200° C. or preferably approximately 140-180° C. for approximately 10-240 minutes or approximately 15-200 minutes or preferably approximately 20-150 minutes or until the desired kappa number has been obtained. As will be appreciated by one of skill in the art, the desired kappa number will depend on the intended use, that is, what type of paper product is being produced. For example, a desirable kappa number may be less than 40, less than 30 or preferably a kappa number of less than 20.

Specifically, in some embodiments in which a kappa number of less than 20 is desirable, bast crops such as flax, hemp, jute, kenaf and the like are used. The sodium hydroxide is added at 12-20% of dry fiber weight and anthraquinone (AQ) is added at 0-2% on a dry fiber basis. The bast crop material is cooked at a temperature between 150-180° C. for 20-150 minutes until the desired kappa number of 20 or less is obtained.

For cereals and perennial grasses, in embodiments in which a kappa number of less than 20 is desirable, sodium hydroxide is added at 12-16% of dry fiber weight and AQ is added at 0-2% of dry fiber weight. The mixture is cooked at 140-170° C. for 20 to 120 minutes until the desired kappa number of 20 or less is obtained.

The sodium hydroxide and anthraquinone, that is, the 'cooking liquor' may be heated, for example, to 80° C., if it is desired that the mixture reaches the cooking temperature more quickly. As will be appreciated by one of skill in the art, heating the liquor to temperatures other than approximately 80° C., for example, approximately 60-100° C. or any temperature above ambient temperature will of course reduce the amount of time required to reach the cooking temperature. It is of note that in general the cooking liquor comprises NaOH and AQ but in some embodiments may include other additives known in the art, for example but by no means limited to, additives to protect the carbohydrates during delignification.

In some embodiments, following cooking in the digester or other suitable device, the cooked material is cooled with water, as discussed herein.

The cooked pulped material is then washed prior to being subjected to a bleaching process.

As will be appreciated by one of skill in the art, any suitable method known in the art for bleaching may be used, for example, totally chlorine free (e.g. using hydrogen peroxide ($H_2O_2$)), elemental chlorine free (using chlorine dioxide, or $ClO_2$), chlorine, hypochlorite ($ClO^-$), oxygen, ozone or the like.

As will be appreciated by one of skill in the art, and as discussed above, a variety of different conditions may be used, depending on the desired result.

The pulp may be dewatered again and the bleaching consistency may be adjusted by adding dilution water. The pH may be adjusted using either sulphuric acid or sodium hydroxide. $ClO_2$ may be added while stirring the pulp. NaOH and $H_2O_2$ are then added.

The bleached pulp is then deflaked by dispersing small fiber bundles present in the pulp blend. It is of note that if these small fiber bundles are not dispersed, clumps and knots will form in the pulp which will impact quality of the resulting paper product. The deflaking may be accomplished by a variety of means known in the art, for example, by recirculating the bleached material through a double disk refiner. As will be appreciated by one of skill in the art, other suitable means of dispersing the fiber bundles may also be used and are within the scope of the invention.

The bleached material can now be utilized for the formation of suitable paper products, as discussed above, using means well known in the art. For example, the bleached material can be dewatered and further processed for use in papermaking or the production of paper sheets, as described herein.

The invention will now be explained by way of examples; however the invention is not necessarily limited to the examples.

The primary objective of this phase of the project was to demonstrate that paper could be made solely from whole flax and wheat fiber, and that the paper could meet the technical specifications of commercially available papers of similar grade.

Table 1 below identifies the targeted and tested values of the finished sheets.

Wheat and flax straw pulps were manufactured according to the Soda-AQ process. Specifically, 12-14% NaOH and 0.1% AQ was added to oven-dried wheat straw at a liquor to solids ratio of 15:1. 22% NaOH and 0.1% AQ was added to the flax straw at a liquor:solids ratio of 9:1. As discussed above, other percentages and ratios may be used within the invention.

The solids content was measured after a homogeneous sampling of the raw materials and wheat or flax straw was introduced into the digesters.

A wire basket was filled with these plants and introduced in the digester before cooking, in order to evaluate the pulp yield.

Cooking liquor was prepared in the liquor preparation tank in the conditions discussed herein. This cooking liquor was heated at 80° C. before being introduced on wheat or flax straws. The heating of the cooking liquor allowed the digester contents to reach the cooking temperature in a shorter time. In this case, the time to the cooking temperature was approximately 30-60 minutes. It is of note that the cooking liquor does not necessarily need to be heated in all embodiments, although doing so clearly reduces the time required to reach the cooking temperature. Accordingly, it is to be understood that heating the cooking liquor to any temperature above ambient will reduce the cooking time.

It is of note that in this example, the wheat straw was heated to 160° C. while the flax straw was heated to 170° C. As discussed herein, other suitable temperatures may be used.

The chemical consumption and the liquor pH were measured in the last minutes of the cooking time.

Initially, cooking of wheat straw was performed with 14% NaOH. Subsequently, this amount of NaOH was decreased to 12% because the kappa number of the pulp manufactured the first day was too low. However the 12% NaOH did not produce a kappa value close to 17. Under these conditions, the kappa of the pulp was too high. Finally, 13% NaOH was used during the cooking process which resulted in a kappa value of 17. Nevertheless, these different wheat pulps were mixed and the kappa of the final pulp was close to 16.5.

Wheat and flax straws were sensitive to mechanical damage. In some trials, blowing the digester from cooking temperature greatly impacted pulp drainage. For this reason, at the end of the cooking, cold water was introduced into the digester in order to cool the raw materials before blowing. Accordingly, in some embodiments, the material is cooled at the end of the cooking process.

Cooking yield, pulp Kappa number, pulp freeness and shives content were measured on unbleached pulps.

After cooking, pulp contained in the drainage chest was transported to the bleaching chest.

The pulp stored in the bleaching chest was sent to the twin-wire press, and sulphuric acid and water were added to the pulp after the shredding screw. The pulp was mixed with steam in single shaft mixer and was transferred to medium consistency pump to be sent to the reactor. Chlorine dioxide ($ClO_2$) was added on the pulp into the reactor in this example although as discussed above other suitable bleaching methods known in the art may be used instead and are within the scope of the invention. A $ClO_2$ solution was prepared from the reaction of $Cl_2$ on $NaClO_2$, leading to $ClO_2$ and an NaCl solution. The stirring speed was increased to 130 rpm in order to facilitate the mixing between the chemicals and the pulp inside the reactor. It is of note however that other suitable stirring speeds may be used, depending on factors such as the specific starting material and the end product. After the retention time had expired, the pulp was unloaded into a chest before starting the next stage.

The pulp contained in the chest was washed on the twin-wire press with an efficiency of about 95-97%. NaOH and $H_2O_2$ were introduced in the shredding screw with the corresponding water to reach the desired consistency. At the end of the reaction, pulp was released into a chest and mixed with water before being sent to a twin-wire press.

Pulp was washed on the twin-wire press and sulphuric acid was added on the pulp after the shredding screw to bring the pH down into the acidic range for subsequent bleaching with chlorine dioxide ($ClO_2$). Pulp was sent to the single shaft mixer, passed through the medium consistency pump and into the reactor. Chlorine dioxide was then introduced continuously at the feeding end of the reactor.

At the end of this bleaching stage, pulp was unloaded to a chest and the pulp was extracted from the pilot plant as pulp rolls at 33% consistency. It is of note that dewatered pulp of other suitable consistencies can be prepared according to the invention using means well known to those of skill in the art.

The Chlorine dioxide caused a depolymerisation of the lignin mainly by attacking of the phenolic structures and olefinic. This chemical has an oxidizing action which leads to the opening of the aromatic ring, formation of quinones, oxiranes or structures of the aliphatic chains which would be oxidized. The $ClO_2$ is used during delignification and during the bleaching.

During delignification, under acidic conditions, the $ClO_2$ is reduced to chlorous and hypochlorous acid. The hypochlorous acid can oxidize the lignin to generate new free phenolic groups which are attacked by $ClO_2$.

In some instances, in order to limit the creation of chromophores at the end of bleaching, it may be necessary to maintain the pH between to a value between 2 and 6 or between 2 and 5 or between 3 and 5 or between 2 and 4 or between 3 and 4.

Alkaline extraction eliminates the lignin made soluble by the previous stages of oxidation and reactivates the pulp for subsequent oxidations. Generally, this stage generates a coloration of the pulp. This decrease of brightness observed during this stage results from reactions with the hydroxyl ion which can lead to the formation of chromophores. However, the use of $H_2O_2$ during this stage avoids a loss of brightness.

The cooking of flax straw produced a pulp with an average kappa number of 16.7, CSF=594 ml and with yield=53.3.

The cooking of wheat straw produced a pulp with an average kappa number=16.3, CSF=443 ml and shive contents=6.3%.

As discussed herein, it is noted that through routine experimentation, other kappa numbers can be easily obtained, for example, by increasing or decreasing cooking time.

It was definitively demonstrated that paper comprised solely of a nonwood fiber mix can meet the technical physical specifications of commercially produced papers made from wood of the same or similar grade. The main positive outcomes were the demonstration of producing aesthetically impressive paper that met nearly every technical specification of commercially produced paper.

The dry/wet processing system appears to condition both the flax and wheat advantageously for subsequent cooking. This process allows lower chemical levels than unprocessed materials due to the removal of water-soluble compounds, and the "fluffing" of the material, allowing better access of the chemicals. The removal of the straw fines is advantageous, especially in increasing freeness.

In order to insure that the liquor would circulate through all of the wheat and flax a high liquor to fiber ratio was used, especially for the wheat.

The ability to cook flax with a lower chemical load (~40% less NaOH) per Oven-Dry (OD) unit appears to result from the dry/wet processing and the subsequent removal of water soluble components and the opening of the shive portion of the flax stalk to the chemistry.

While the preferred embodiments of the invention have been described above, it will be recognized and understood that various modifications may be made therein, and the appended claims are intended to cover all such modifications which may fall within the spirit and scope of the invention.

The invention claimed is:

1. A method of preparing photocopy paper from a whole straw nonwood fiber source comprising:

chopping a quantity of a dry whole straw nonwood fiber source to an average length between 1-100 mm, wherein the whole straw nonwood fiber is a mixture of 60-90% wheat and 10-40% flax;

wet processing the chopped whole straw material to remove dirt, fines and water-soluble extractives;

dewatering the chopped whole straw material;

pre-heating a cooking liquor comprising 5-50% NaOH (w/w) and 0-10% anthraquinone (w/w) to a temperature between 60-100° C.;

heating the chopped whole straw material in the cooking liquor for 10-240 minutes to a temperature between 100-240° C.;

washing the heated chopped material;

bleaching the washed material;

deflaking the bleached material; and forming the deflaked, bleached material into photocopy paper sheets.

2. The method according to claim 1 wherein the whole straw nonwood fiber is a mixture of 70-90% wheat and 10-30% flax.

3. The method according to claim 1 wherein the anthraquinone is added at 0-5% (w/w).

4. The method according to claim 1 wherein the anthraquinone is added at 0-2% (w/w).

5. The method according to claim 1 wherein the NaOH is added at 10-40% (w/w).

6. The method according to claim 1 wherein the NaOH is added at 12-30% (w/w).

7. The method according to claim 1 wherein the whole straw material is chopped to an average length between 3-75 mm.

8. The method according to claim 1 wherein the whole straw material is chopped to an average length between 5-50 mm.

9. The method according to claim 1 wherein the chopped whole straw material is cooked for 15-200 minutes.

10. The method according to claim 1 wherein the chopped whole straw material is cooked for 20-150 minutes.

TABLE 1

Targeted verses achieved values

| Specification | Targeted | Achieved Value as reported by | | |
|---|---|---|---|---|
| Tested by | Value | Lab #1 | Lab #2 | Lab #3 |
| Basis Weight, $g/m^2$ | 75-90 | 89.9 | 88.1 | 88.3 |
| Caliper, μm | 100-130 | 117 | 4.13 mils (104.9 μm)* | 121 |
| Tensile Index, N m/g | 37-72 | 25.6 CD 64.9 MD 45.3 AVG | 25.2 CD 65.1 MD 45.2 AVG | 28.3 CD 59.8 MD 44.0 AVG |
| Burst Index, $kPa*m^2/g$ | 1.65-3.05 | NR | 2.66 AVG | 2.62 |
| Tear Index, mN $m^2/g$ | 6.00-7.00 | 9 MD, 10.8 CD, 9.9 AVG | 4.81 MD 5.86 CD 5.34 AVG | 5.9 MD 6.7 CD 6.3 AVG |
| Brightness, $^0$ISO | 85 | 85.3 | 84.9 AVG | 82.0 |
| Stiffness, Gurley (mg) | 135 MD, 60 CD | Taber 3.2 mNm MD 1.5 mNm CD | 174 MD 77.9 CD 126 AVG | Taber 3.3 mNm MD 1.6 mNm CD |
| Opacity, ISO % | 84 | 92.2 | 91.3 | 90.3 TS 90.6 BS |
| Sheffield Smoothness (Roughness) | 130-170 | 116 top side-159 bottom side | 119 top-166 bottom | 539 top-862 bottom |

11. The method according to claim 1 wherein the chopped whole straw material is cooked to a temperature between 120-200° C.

12. The method according to claim 1 wherein the chopped whole straw material is cooked to a temperature between 140-180° C.

13. The method according to claim 1 wherein the chopped whole straw material is cooled with water following cooking.

14. A method of preparing a paper product from a whole straw nonwood fiber source comprising:

chopping a quantity of a dry whole straw nonwood fiber source to an average length between 1-100 mm, wherein the whole straw nonwood fiber is a mixture of 60-90% wheat and 10-40% flax;

wet processing the chopped whole straw material to remove dirt, fines and water-soluble extractives;

dewatering the chopped whole straw material;

pre-heating a cooking liquor comprising 5-50% NaOH (w/w) and 0-10% anthraquinone (w/w) to a temperature between 60-100° C.;

heating the chopped whole straw material in the cooking liquor for 10-240 minutes to a temperature between 100-240° C.;

washing the heated chopped material;

bleaching the washed material;

deflaking the bleached material; and forming the deflaked material into a paper product.

15. The method according to claim 14 wherein the paper product is selected from the group consisting of toilet paper, tissue paper, paper towels, wrapping paper, box board, photo paper, colored paper, printing paper, writing paper, stationery, sack paper and paper board.

16. The method according to claim 14 wherein the anthraquinone is added at 0-5% (w/w).

17. The method according to claim 14 wherein the anthraquinone is added at 0-2% (w/w).

18. The method according to claim 14 wherein the NaOH is added at 10-40% (w/w).

19. The method according to claim 14 wherein the NaOH is added at 12-30% (w/w).

20. The method according to claim 14 wherein the whole straw material is chopped to an average length between 3-75 mm.

21. The method according to claim 14 wherein the whole straw material is chopped to an average length between 5-50 mm.

22. The method according to claim 14 wherein the chopped whole straw material is cooked for 15-200 minutes.

23. The method according to claim 14 wherein the chopped whole straw material is cooked for 20-150 minutes.

24. The method according to claim 14 wherein the chopped whole straw material is cooked to a temperature between 120-200° C.

25. The method according to claim 14 wherein the chopped whole straw material is cooked to a temperature between 140-180° C.

26. The method according to claim 14 wherein the chopped whole straw material is cooled with water following cooking.

* * * * *